US005373301A

United States Patent [19]

Bowers et al.

[11] Patent Number: 5,373,301

[45] Date of Patent: Dec. 13, 1994

[54] TRANSMIT AND RECEIVE ANTENNA HAVING ANGLED CROSSOVER ELEMENTS

[75] Inventors: John H. Bowers, Clarksburg; Philip J. Lizzi, Deptford, both of N.J.

[73] Assignee: Checkpoint Systems, Inc., Thorofare, N.J.

[21] Appl. No.: 321

[22] Filed: Jan. 4, 1993

[51] Int. Cl.[5] ..... H01Q 11/12

[52] U.S. Cl. ..... 343/742; 343/74; 343/867; 340/572

[58] Field of Search ..... 343/742, 866, 867, 741, 343/842, 743, 744, 870; 340/572; H01Q 11/12

[56] References Cited

U.S. PATENT DOCUMENTS

| | | | |
|---|---|---|---|
| 2,910,695 | 10/1959 | Troost et al. | 343/867 |
| 3,696,379 | 10/1972 | Minasy | 340/280 |
| 3,747,086 | 7/1973 | Peterson | 340/280 |
| 3,938,044 | 2/1976 | Lichtblau | 325/22 |
| 4,151,405 | 4/1979 | Peterson | 235/382 |
| 4,251,808 | 2/1981 | Lichtblau | 340/572 |
| 4,260,990 | 4/1981 | Lichtblau | 343/742 |
| 4,281,321 | 7/1981 | Narlow et al. | 340/572 |
| 4,509,039 | 4/1985 | Dowdle | 340/572 |
| 4,751,516 | 6/1988 | Lichtblau | 343/742 |
| 4,769,631 | 9/1988 | Copeland | 340/551 |
| 4,963,880 | 10/1990 | Torre et al. | 343/866 |
| 5,103,234 | 4/1992 | Watkins et al. | 343/742 |
| 5,103,235 | 4/1992 | Clemens | 343/867 |

FOREIGN PATENT DOCUMENTS

| | | |
|---|---|---|
| 0100128 | 7/1983 | European Pat. Off. . |
| 53-142260 | 11/1978 | Japan . |

*Primary Examiner*—Donald Hajec
*Assistant Examiner*—Hoanganh Le
*Attorney, Agent, or Firm*—Panitch Schwarze Jacobs & Nadel

[57] ABSTRACT

An antenna for simultaneously transmitting and receiving electromagnetic energy is disclosed. The antenna includes first and second transmit elements and a transmitter for supplying a first current to the first transmit element and a second current to the second transmit element such that the first and second transmit elements radiate electromagnetic fields. Preferably, the supplied first and second currents are substantially equal. The antenna also includes a sensor for sensing differences between currents flowing through the first and second transmit elements. The differences are caused by an electromagnetic field external to the antenna such that the antenna effectively receives the external electromagnetic field by sensing the current differences.

10 Claims, 1 Drawing Sheet

TRANSMIT AND RECEIVE ANTENNA HAVING ANGLED CROSSOVER ELEMENTS

FIELD OF THE INVENTION

The present invention generally relates to antennas, and more particularly to antennas which simultaneously transmit and receive electromagnetic energy.

BACKGROUND OF THE INVENTION

Conventionally, antennas include separate components for transmitting and receiving electromagnetic energy, such as a first antenna for transmitting electromagnetic energy and a separate and distinct second antenna for receiving electromagnetic energy. As will be appreciated, such conventional antenna assemblies are not well suited for applications where space is at a premium, or where maximum coupling is required between an antenna and a transponder for simultaneous transmission and reception. Systems having these performance requirements include, for example, electronic article surveillance (EAS) systems and other systems in which simultaneous bi-directional communication is required.

Other conventional antennas including a single component for both transmitting and receiving electromagnetic energy typically have a mechanism for switching an antenna between a signal generator and a receiving mechanism, such that, at any particular time, the antenna either transmits or receives electromagnetic energy. In other words, these conventional antennas cannot simultaneously transmit and receive electromagnetic energy. As will be appreciated, such conventional antennas are not suited for use in applications where the simultaneous transmission and reception of electromagnetic energy by a single antenna are required.

SUMMARY OF THE INVENTION

Briefly stated, the present invention is directed to an antenna for simultaneously transmitting and receiving electromagnetic energy. The antenna includes first and second transmit elements and is attached to means for supplying a first current to the first transmit element and a second current to the second transmit element such that the first and second transmit elements radiate electromagnetic fields. Preferably, the supplied first and second currents are substantially equal. The antenna is attached to means for sensing differences between currents flowing through the first and second transmit elements. The current differences, caused by the external electromagnetic fields, are converted to a received signal by the current difference sensing means. In this way, the antenna receives the external electromagnetic fields.

BRIEF DESCRIPTION OF THE DRAWINGS

The foregoing summary, as well as the following detailed description, is better understood when read in conjunction with the appended drawings. For the purpose of illustrating the invention, embodiments which are presently preferred are shown in the drawings. It is understood, however, that this invention is not limited to the precise arrangements and instrumentalities shown. In the drawings.

DETAILED DESCRIPTION OF THE PREFERRED EMBODIMENTS

Figure 1:
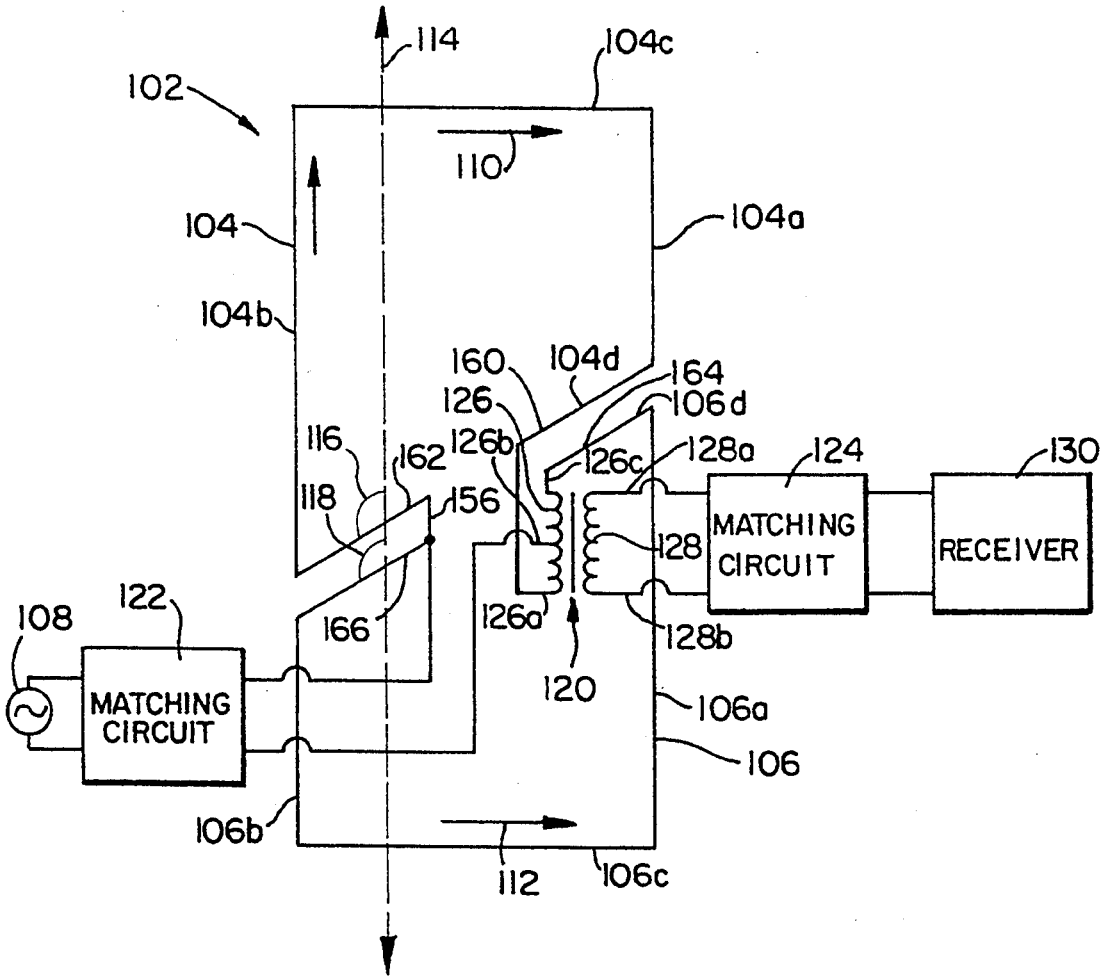
FIG. 1 is an electrical schematic diagram of an antenna in accordance with a preferred embodiment of the present invention.

The present invention is directed to an antenna for simultaneously transmitting and receiving electromagnetic energy at one or more frequencies within a predetermined frequency range, and to an antenna where the size of the antenna may be less than the wavelength of the electromagnetic energy to be transmitted and received. The predetermined frequency range preferably comprises radio frequencies (defined herein as 1,000 Hz and above), such as 8.2 MHz, for example. However, it should be understood that the predetermined frequency range may comprise other frequencies without departing from the scope of the present invention.

The antenna of the present invention is well suited for use in systems where it is desirable to simultaneously transmit and receive electromagnetic fields within close proximity (i.e., less than one-half wavelength) of the antenna. An example of such a system is an electronic article surveillance (EAS) system where the antenna is used to establish a surveillance zone. A tag circuit inside the surveillance zone is powered by the emitted electromagnetic field such that the tag radiates electromagnetic energy. The antenna detects the presence of the tag in the surveillance zone by receiving the electromagnetic energy radiated by the tag. In this manner, unauthorized removal of protected articles, to which the tag is affixed, from the surveillance zone is prevented.

The antenna of the present invention is described herein with reference to EAS systems. However, such reference to EAS systems is provided for illustrative purposes only and is not limiting. The antenna of the present invention is well suited for use in many other types of applications, and more particularly, has application in any area in which the electromagnetic energy radiated by the antenna is used to perform a communication or identification function. For example, the antenna of the present invention can be used in conjunction with a sensor (which is powered, by the electromagnetic energy transmitted by the antenna) in an environment where it is difficult to power or otherwise communicate with the sensor via wires connected to the sensor. In this environment, the antenna could be used to remotely power and receive information from the sensor. For example, the antenna of the present invention could be used in conjunction with a sensor which measures a patient's blood sugar level, wherein the blood sugar level sensor is subcutaneously implanted into the patient's tissue. As will be appreciated, it is highly desirable that the patient's skin not be punctured with wires to connect to the sensor. It is also highly desirable to eliminate batteries from the sensor. With the present invention, it is possible to use the electromagnetic energy generated by the antenna to power the sensor located beneath the patient's skin and to simultaneously use the antenna to receive the electromagnetic energy transmitted by the sensor, wherein the electromagnetic energy transmitted by the sensor relates to the patient's blood sugar level. Another application is related to communicating with a passive transponder that identifies its owner for access control. Other useful applications of the present invention will be apparent to those skilled in the art.

Referring now in detail to the drawings, wherein like reference numerals indicate similar elements throughout, there is shown in FIG. 1 an electrical schematic diagram of an antenna 102 in accordance with a preferred embodiment of the present invention. The antenna 102 includes a first transmit element which preferably comprises a first antenna loop 104, and a second transmit element which preferably comprises a second antenna loop 106. Alternatively, one or both of the first and second transmit elements may comprise other types of antennas, such as coil antennas. In the preferred embodiment, the first and second antenna loops 104, 106 are generally co-planar with the first antenna loop 104 above the second antenna loop 106 such that the first antenna loop 104 forms an upper or top loop and the second antenna loop 106 forms a lower or bottom loop. However, it will be appreciated by those skilled in the art that the first and second antenna loops 104, 106 may be arranged in some other, preferably planar, orientation, such as side by side, without departing from the scope of the present invention.

The first and second antenna loops 104, 106 are each preferably comprised of one or more turns of a conductor or wire of any suitable type. However, it will be appreciated by those skilled in the art that other conducting elements may be used, if desired, without departing from the scope of the present invention. For example, it may be desirable to use mechanically functional structural elements to make up the first and second antenna loops 104, 106. Alternatively, electrically conductive decorative elements may be used.

In the preferred embodiment, the first and second antenna loops 104, 106 include a common axis 114. The first antenna loop 104 is generally in the shape of a quadrilateral and includes first and second sides **104*a*, 104*b*, each generally parallel to the axis 114, a third side 104*c* generally perpendicular to and extending between the first and second sides 104*a*, 104*b*, and a fourth side 104*d* extending between the first and second sides 104*a*, 104*b* at a first predetermined angle 116 relative to the axis 114. The first, second and third sides 104*a*, 104*b* and 104*c* of the first antenna loop 104 may alternatively be formed in different shapes, such as semicircular or semi-oval, without departing from the scope of the present invention. The second antenna loop 106 is also generally in the shape of a quadrilateral and includes first and second sides 106*a*, 106*b*, each generally parallel to the axis 114, a third side 106*c* generally perpendicular to and extending between the first and second sides 106*a*, 106*b*, and a fourth side 106*d* extending between the first and second sides 106*a*, 106*b* at a second predetermined angle 118 relative to the axis 114. The first, second and third sides 106*a*, 106*b* and 106*c* of the second antenna loop 106 may alternatively be formed in different shapes, such as semicircular or semi-oval, without departing from the scope of the present invention. Preferably, the first predetermined angle 116 associated with the first antenna loop 104 is substantially equal to the second predetermined angle 118 associated with the second antenna loop 106 such that the first and second antenna loops 104, 106 are generally parallel to each other. They are preferably spaced slightly apart along their respective fourth sides 104*d*, 106*d*, but may be positioned relative to each other in any manner which gives desired performance. Preferably, the first antenna loop 104 is substantially equal in area and perimeter (i.e., the areas enclosed by the first and second antenna loops 104, 106 are equal) to the second antenna loop 106, such that when the first and second antenna loop 104, 106 are oriented as shown in FIG. 1 with the first antenna loop 104 on the top and the second antenna loop 106 on the bottom, and with the fourth sides 104*d*, 106*d* adjacent to each other, the overall shape of the combined first and second antenna loops 104, 106** is generally rectangular.

As noted above, the first and second antenna loops 104, 106 are generally parallel to each other and preferably spaced slightly apart along their respective fourth sides **104*d*, 106*d*. Alternatively, the first and second antenna loops 104, 106 may be directly adjacent to each other or may slightly overlap along the fourth sides 104*d*, 106*d*** without departing from the scope of the present invention.

The fourth side **104*d* of the first antenna loop 104 includes a first end 160 and a second end 162. Similarly, the fourth side 106*d* of the second antenna loop 106 includes a first end 164 and a second end 166. The first ends 160, 164 are connected to a current difference sensing means (described below), and in the preferred embodiment, are connected to opposite ends 126*a*, 126*c*, respectively, of a primary winding 126 of a center tapped transformer 120. The second ends 162, 166 are preferably joined together by a conductor 156 which is connected to a first matching circuit or network 122 (described below). In the preferred embodiment, a center tap 126*b* of the transformer primary winding 126 is also connected to the first matching network 122**, although it should be understood that this structure may be different in embodiments where the sensing means does not include a transformer.

The antenna 102 is attached to means, such as a transmitter 108, for supplying a first current to the first antenna loop 104 and a second current to the second antenna loop 106 such that the first and second antenna loops 104, 106 radiate electromagnetic fields. Preferably, the first and second currents are substantially equal (in magnitude and phase). The transmitter 108 is a conventional transmitter comprised of a signal oscillator and a suitable amplifier/filter network of a type capable of driving the load impedance presented by the combination of the matching circuit 122 and the antenna loops 104, 106. As will be appreciated, the frequency at which the first and second antenna loops 104, 106 radiate electromagnetic fields substantially depends on the oscillation rate of the transmitter 108. Thus, the frequency may be set and adjusted by appropriately adjusting the transmitter 108 in a well known manner.

The transmitter 108 is connected to the first matching circuit 122 and provides an amplified, preferably RF (radio frequency) signal to the first and second antenna loops 104, 106 through the first matching circuit 122. The first matching circuit 122 represents a suitable impedance matching network so that when combined with the impedance presented by the first and second antenna loops 104, 106, preferably a resistive impedance is presented to the transmitter 108. Presenting a resistive impedance to the transmitter 108 allows a greater range of transmitter circuits to drive the antenna because most transmitter circuits are designed to optionally drive a resistive load. The first matching circuit 122 preferably comprises a pair of resistors (not shown) connected in series with a pair of capacitors (not shown). However, other matching circuits may be used without departing from the scope of the present invention.

As noted above, the first matching circuit 122 is connected to the conductor 156 and to the center tap **126*b*** of the transformer primary winding 126. In this manner, the transmitter 108 supplies the first current in a first angular direction to the first antenna loop 104 and supplies the second current in a second angular direction opposite the first angular direction to the second antenna loop 106. The first and second angular directions are indicated by flow arrows 110 and 112, respectively. As noted above, the first and second currents supplied to the first and second antenna loops 104, 106, respectively, are substantially equal. Since the currents flowing through the first and second antenna loops 104, 106 are generally equal but opposite in direction, and since the first and second antenna loops 104, 106 are generally equal in area, the magnetic fields radiated by the first and second antenna loops 104, 106 are generally equal in magnitude (as is well known, the magnitude of the magnetic field radiated by an antenna loop corresponds to the current flowing through the antenna loop multiplied by the area of the antenna loop) but opposite in direction (that is, they are 180° out of phase). Consequently, the electromagnetic fields generated by the first and second antenna loops 104, 106 substantially cancel in the far field. (An antenna's far field is an area multiple wavelengths away from the antenna. If the antenna is multiple wavelengths in size, then the antenna's far field is an area multiple antenna lengths from the antenna. For an antenna operating at 8.2 MHz, the Federal Communication Commission defines the far field as an area thirty meters from the antenna.) In other words, the antenna 102 of the present invention substantially achieves far field cancellation of the electromagnetic fields generated by the first and second antenna loops 104, 106.

Alternatively, the antenna 102 of the present invention can be configured such that the electromagnetic fields generated by the first and second antenna loops 104, 106 are in the same direction, and thus do not cancel in the far field. This may be accomplished, for example, by having the transmitter 108 drive the secondary winding 128 of the transformer 120 such that the currents supplied to the first and second antenna loops 104, 106 flow in the same direction.

As noted above, the fourth side **104*d* of the first antenna loop 104 extends between the first and second sides 104*a*, 104*b* of the first antenna loop 104 at a first predetermined angle 116 relative to the axis 114. The fourth side 106*d* of the second antenna loop 106 extends between the first and second sides 106*a*, 106*b* of the second antenna loop 106 at a second predetermined angle 118 relative to the axis 114. Preferably, the first predetermined angle 116 and the second predetermined angle 118 are both substantially equal to a predetermined value which is other than 90°, such that the fourth sides 104*d*, 106*d* represent angled crossover elements, or an angled crossover region, between the respective first sides 104*a*, 106*a* and second sides 104*b*, 106*b* of the first and second antenna loops 104, 106. The first and second predetermined angles 116, 118** are presently preferably equal to 60° but any other suitable angle could alternatively be employed.

As described herein, the antenna 102 includes both a transmitting antenna component and a receiving antenna component. As will be appreciated by those skilled in the art, a first coupling coefficient exists between the transmitting antenna component and a transponder (for example, a tag in an EAS system) and a second coupling coefficient exists between the receiving antenna component and the transponder. In order for the receiving antenna component to detect the transponder when the transponder is irradiated by the transmitting antenna component, both the first coupling coefficient and the second coupling coefficient must be non-zero. However, around the crossover region in antennas configured according to the above description, the first or second coupling coefficients are substantially equal to zero. Therefore, the crossover region represents a null zone because a transponder proximate the crossover region cannot be detected by the receiving antenna component of the antenna.

If the first and second predetermined angles 116, 118 were equal to 90° such that the crossover region was parallel to the floor, then (with respect to EAS systems) it would be relatively easy for a person (i.e., a shoplifter) to steal a protected article since the shoplifter could pass undetected through the surveillance zone by holding the protected article (and the tag affixed thereto) at a constant height above the floor (coincident with the null region) while passing through the surveillance zone.

In contrast, it is much more difficult for a transponder to be carried undetected past the antenna 102 of the present invention since the null region tracks the diagonal of the angled crossover region. With respect to EAS systems, a shoplifter would have to adjust the height of the protected article to match the angle of the crossover region to pass through the surveillance zone undetected- Therefore, the use of the angled crossover region in the antenna 102 of the present invention makes it difficult for a shoplifter to steal protected articles. Although the above has focused on EAS systems, it will be apparent to those skilled in the art that the advantages of using an angled crossover region applies to other applications of the antenna 102, such as in access control systems and in systems where a subcutaneously implanted transponder is powered and sensed by the antenna.

As noted above, the antenna 102 simultaneously transmits and receives electromagnetic fields at a predetermined frequency. The manner in which the antenna 102 transmits electromagnetic fields was described above. The manner in which the antenna 102 receives electromagnetic fields shall now be described.

In order to receive external electromagnetic fields, the antenna 102 is attached to means for sensing differences (both magnitude and phase) between currents flowing through the first and second antenna loops 104, 106. The current differences are caused by an electromagnetic field external to the antenna 102 such that the antenna 102 effectively receives the external electromagnetic field by sensing the current differences. In the case where the antenna 102 is used in an EAS system, the external electromagnetic field may be caused by a tag circuit passing near the antenna 102 (more particularly, passing within the surveillance zone). In this instance, the sensed current differences would confirm that the tag circuit was in the surveillance zone.

In the presently preferred embodiment, the sensing means comprises the transformer 120, a second matching circuit or network 124, and a receiver 130. A secondary winding 128 of the transformer 120 is connected to the second matching circuit 124. The receiver 130 is also connected to the second matching circuit 124. The second matching circuit 124 is similar in operation to the first matching circuit 122 in that the second matching circuit 124 in combination with other components of the antenna 102 present a resistive load to the receiver 130. In the presently preferred embodiment, the second matching circuit 124 includes a capacitor (not shown), but some other matching circuit could be employed without departing from the scope of the present invention.

As noted above, in the preferred embodiment, opposite ends 126*a*, 126*c* of the transformer primary winding 126 are respectively connected to the first end 160 of the fourth side 104*d* of the first antenna loop 104 and to the first end 164 of the fourth side 106*d* of the second antenna loop 106. In this manner, current flowing in the first antenna loop 104 flows through the transformer primary winding 126 in a first direction (denoted by flow arrow 110) and current flowing in the second antenna loop 106 flows through the transformer primary winding 126 in a second direction (denoted by flow arrow 112) opposite the first direction, such that electromagnetic flux generated by the currents passing through the transformer primary winding 126 is zero when the currents flowing through the first and second antenna loops 104, 106 are equal. In contrast, any difference in the currents flowing through the transformer primary winding 126 results in a net magnetic flux in the transformer primary winding 126. The net magnetic flux in the transformer primary winding 126 causes a voltage to be generated on the transformer secondary winding 128 in proportion to the current difference. It will be appreciated by those skilled in the art that the function of sensing differences between the currents flowing in the first and second antenna loops 104, 106 can be performed in some other manner than just described without departing from the scope of the present invention. For example, a directional coupler (not shown) could be used to sense current differences. Alternatively, a bridge circuit (not shown) could be used wherein the first and second antenna loops 104, 106 would comprise two elements of the bridge circuit.

The voltage generated at the transformer secondary winding 128 is applied to the receiver 130 via the second matching circuit 124. The receiver 130 responds to the voltage in a manner which is dependent on the application of the antenna 102. For example, if the antenna 102 is being used in an EAS system, then the receiver 130 may generate an alarm (such as an audible, silent, visual, etc., alarm) upon receiving the voltage from the transformer secondary winding 128 to thereby alert appropriate personnel that a tag is in the surveillance zone.

Figure 2:
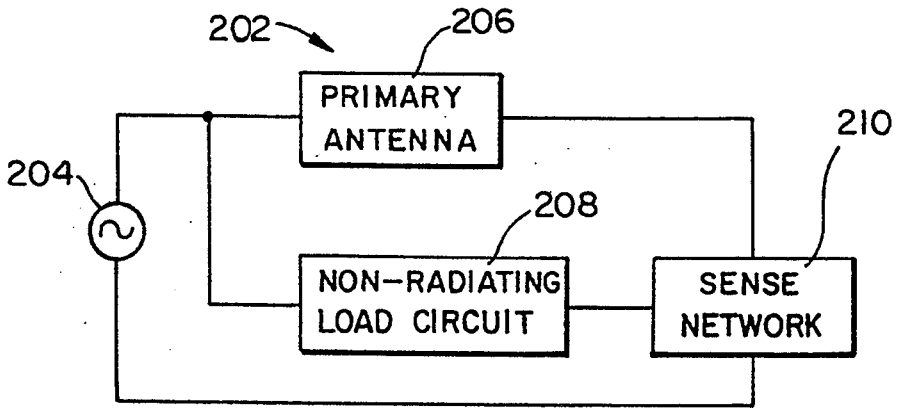
FIG. 2 is a block diagram of an antenna in accordance with an alternate embodiment of the present invention.

FIG. 2 illustrates a block diagram of an antenna 202 in accordance with an alternate embodiment of the present invention. Antenna 202 includes a primary antenna 206 which may comprise multiple transmit elements, like that shown in FIG. 1, such that the electromagnetic fields generated by the primary antenna 206 are substantially cancelled in the far field. However, the primary antenna 206 may alternatively comprise a single transmitting element or any other suitable configuration without departing from the scope of the present invention.

The antenna 202 also includes a non-radiating load circuit 208 which has an impedance substantially equal to an impedance of the primary antenna 206. The non-radiating load circuit 208 may be comprised of an inductor which is configured to be non-radiating. Such inductors are well known and are often used in radio receiver circuits and/or as part of LC filter networks.

The antenna 202 is also attached to means, such as a transmitter 204, for supplying a first current to the primary antenna 206 such that the primary antenna 206 radiates electromagnetic fields. The transmitter 204 also supplies a second current to the non-radiating load circuit 208 wherein the supplied second current is preferably substantially equal to the first current supplied to the primary antenna 206. The transmitter 204 is similar to the transmitter 108 shown in FIG. 1, and therefore shall not be described further. The antenna 202 may also be attached to a matching circuit similar to the first matching circuit 122 shown in FIG. 1, for presenting a resistive load to the transmitter 204.

The antenna 202 is also attached to means, such as a sense network 210, for sensing differences between currents flowing through the primary antenna 206 and the non-radiating load circuit 208. The current differences are caused by an electromagnetic field external to the antenna 202 such that the antenna 202 effectively receives the external electromagnetic field by sensing the current differences. As noted above, the external electromagnetic field could be caused by a tag circuit within the surveillance zone (when the antenna 202 is used in an EAS system). The sense network 210 is preferably structurally and operationally similar to the sensing means of the antenna 102 shown in FIG. 1 (that is, the transformer 120, the second matching circuit 124, and the receiver 130), although other types of current sensing devices can alternatively be used without departing from the scope of the present invention.

As those skilled in the art will appreciate in light of the teachings contained herein, the configurations of the transmit and receive components of the primary antenna 206 are substantially the same since the primary antenna 206 is connected in a bridge-like network with the non-radiating load circuit 208. Since the configurations of the transmit and receive components of the primary antenna 206 are the same, the flux orientations of the transmit and receive components of the primary antenna 206 are substantially identical. Therefore, unlike the antenna 102 shown in FIG. 1, the antenna 202 shown in FIG. 2 does not generate a null zone. Consequently, the antenna 202 detects transponders irradiated by the transmit component of the primary antenna 206, notwithstanding the orientations of the transponders with respect to the antenna 202.

The present invention may be embodied in other specific forms without departing from the spirit or essential attributes thereof and, accordingly, reference should be made to the appended claims, rather than to the foregoing specification, as indicating the scope of the invention.

We claim:

1. An antenna for simultaneously transmitting and receiving electromagnetic energy, comprising:

first and second transmit elements;

means for supplying a first current to the first transmit element and a second current to the second transmit element such that the first and second transmit elements radiate electromagnetic fields, wherein the supplied first and second currents are substantially equal; and means for sensing differences between currents flowing through the first and second transmit elements, wherein the differences are caused by an electromagnetic field external to the antenna such that the antenna effectively receives the external electromagnetic field by sensing the current differences.

2. The antenna of claim 1, wherein the first and second transmit elements each comprises an antenna loop having an axis, a first section having first and second ends, and a second section extending between the first and second ends of the first section at a predetermined angle relative to the axis, the first and second transmit elements being generally parallel to each other and spaced slightly apart along the respective second sections, the predetermined angle of the first transmit element and the predetermined angle of the second transmit element being substantially equal to a value other than 90° such that an angled null zone is achieved.

3. The antenna of claim 2, wherein the first section comprises first and second sides each generally parallel to the axis, and a third side generally perpendicular to and extending between the first and second sides.

4. The antenna of claim 1, wherein the first and second transmit elements each comprises an antenna loop having an axis, first and second sides each generally parallel to the axis, a third side generally perpendicular to and extending between the first and second sides, and a fourth side extending between the first and second sides at a predetermined angle relative to the axis, the first and second transmit elements being generally parallel to each other and spaced slightly apart along the respective fourth sides, the predetermined angle of the first transmit element and the predetermined angle of the second transmit element being substantially equal to a value other than 90° such that an angled null zone is achieved.

5. The antenna of claim 1, wherein the first transmit element comprises an antenna loop.

6. The antenna of claim 1, wherein the first and second transmit elements comprise first and second antenna loops, respectively.

7. The antenna of claim 6, wherein the first and second antenna loops comprise a single conductive wire.

8. The antenna of claim 1, wherein the first transmit element is substantially equal in area to the second transmit element, and wherein the means for supplying the first and second currents comprises means for supplying the first current in a first angular direction to the first transmit element and for supplying the second current in a second angular direction opposite the first angular direction to the second transmit element, such that far field cancellation of electromagnetic fields generated by the antenna is substantially achieved.

9. The antenna of claim 1, wherein the sensing means comprises a transformer having a primary winding, the transformer being connected to the first and second transmit elements such that current in the first transmit element flows through the transformer primary winding in a first direction and current in the second transmit element flows through the transformer primary winding in a second direction opposite the first direction, such that electromagnetic flux generated by the transformer is zero when the currents flowing through the first and second transmit elements are equal and not zero when the currents flowing through the first and second transmit elements are not equal.

10. An antenna for simultaneously transmitting and receiving electromagnetic energy, comprising:

a primary antenna;

a non-radiating load circuit having an impedance substantially equal to an impedance of the primary antenna;

means for supplying a first current to the primary antenna such that the primary antenna radiates electromagnetic fields;

means for supplying a second current to the non-radiating load circuit wherein the supplied second current is substantially equal to the first current supplied to the primary antenna; and means for sensing differences between currents flowing through the primary antenna and the non-radiating load circuit, wherein the differences are caused by an electromagnetic field external to the antenna such that the antenna effectively receives the external electromagnetic field by sensing the current differences.

* * * * *